United States Patent [19]

Gist

[11] Patent Number: 4,526,412

[45] Date of Patent: Jul. 2, 1985

[54] SECURITY DEVICE TO PREVENT REMOVAL OF SLIDING WINDOWS AND DOORS

[76] Inventor: Alfred Gist, Rte. 1, Box 110, Bandon, Oreg. 97411

[21] Appl. No.: 510,630

[22] Filed: Jul. 5, 1983

[51] Int. Cl.[3] ..... B65D 45/32

[52] U.S. Cl. ..... 292/258; 292/300; 292/DIG. 46

[58] Field of Search ..... 292/258, 288, DIG. 46, 292/300; 248/228

[56] References Cited

U.S. PATENT DOCUMENTS 4,062,576 12/1977 Jennings et al. ..... 292/258
4,304,429 12/1981 Gist ..... 292/258

FOREIGN PATENT DOCUMENTS 606148 8/1948 United Kingdom ..... 248/228

*Primary Examiner*—Gary L. Smith
*Assistant Examiner*—Thomas J. Dubnicka
*Attorney, Agent, or Firm*—Francis X. LoJacono

[57] ABSTRACT

A security device to prevent the unauthorized removal of sliding windows and doors from the frame structures in which they are slidably supported. The device is defined by a security clip having a substantially flat wall forming a mainstay and a spring-tension-jaw member integrally formed along the lower edge thereof. The security clip is arranged to be force-fitted over the depending flange of the frame structure, whereby the clip is held in a predetermined position relative to the sliding window or door. In order to prevent upward lifting of the window or door, the wall mainstay is formed having an inwardly bent, abutment lip for engagement with the window when raised from the lower frame-structure track. Ears are formed at the opposite ends of the abutment lip for engagement with the depending flange so as to reinforce and increase the strength and resistance of the abutment lip. A spacer bar is adapted to be positioned on the abutment-lip member to accommodate the various sizes of windows or doors.

8 Claims, 6 Drawing Figures

SECURITY DEVICE TO PREVENT REMOVAL OF SLIDING WINDOWS AND DOORS

BACKGROUND OF THE INVENTION

1. Field of the Invention

This invention relates generally to a security device for windows and doors, and more particularly to a security-clip member adapted for use with sliding windows and doors to prevent them from being lifted vertically within the frame structure on which they are slidably mounted.

2. Description of the Prior Art

It is well known in the art that various problems and difficulties are being encountered in providing suitable means for preventing unauthorized entry through sliding windows and doors that are capable of being lifted vertically within the window or door frame structures.

Many types of security and lock devices are used for this purpose. However, these devices usually have features that restrict their use, and they are not often compatible with aluminum frame structures. The prior-art devices are also sometimes complicated to install and operate, and expensive to manufacture as well as to install, often requiring alterations to either the window/door or its frame structure.

As examples of some known devices one may refer to the following United States patents:

U.S. Pat. No. 3,698,883 discloses a sliding panel-lock device which includes a stop member formed having an exterior shape of a trapezoidal prism which is resilient. This stop member is force-fitted into the header channel of a frame structure.

There is disclosed in U.S. Pat. No. 3,649,559 a security device for sliding windows and doors that includes a lift preventer which is secured to the top rail of the window/door and is defined by a U-shaped clip having a down-turned flange on two sides, one flange having an outwardly curved portion so as to underlie the lower edge of the outer wall of the window track and project outwardly therefrom.

SUMMARY OF THE INVENTION

The present invention has for an important object to provide a security device that prevents unauthorized removal of a sliding window or door from its associated frame structure, in order to gain entry from the outside of a building.

Another object of the invention is to provide a security device to prevent removal of sliding windows and doors, the device being adapted to be inserted within the upper channel of a window/door frame structure, whereby upward movement of the window or door is limited, so as to prevent the disengagement of the lower edge portion of the window/door member from the bottom track of the frame structure.

Still another object of the invention is to provide a security device of this character that is simply clipped to the inner channel of the window-frame structure, without the need for special tools to mount the device.

It is still another object of the invention to provide a security device of this type that comprises a clip having a spring-tension-clasp end formed along the lower edge of a flat-wall mainstay. The upper end of the mainstay is bent inwardly so as to define a flange. Each end of the flange is bent angularly upward, defining ears to abut against one wall of the frame channel.

A further object of the present invention is to provide a security device of this character that is adapted to receive a spacer member removably attached to the flange of the clip, wherein the flange includes spaced crimps between which the spacer member is located, so as to prevent it from longitudinal movement along the flange.

A still further object of the invention is to provide a security device of this character that includes an adjustable spacer wherein the security clip can be used with various sized window/door frames, whereby the clip can be used with or without the spacer or the spacer can be used having two selective spacer positions to accommodate varying window clearances within a given window frame.

It is still another object of the invention to provide a security device of this character that allows the sliding window or door to move freely within the frame structure, without binding.

Still another object of the invention is to provide a device of this type that prevents a burglar from gaining entry to a house or other building by lifting the sliding window or door from its frame structure.

It is still a further object of the invention to provide a security device of this character that is simple, yet is rugged in construction so as to positively engage the sliding window or door when it is lifted upwardly against the device.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
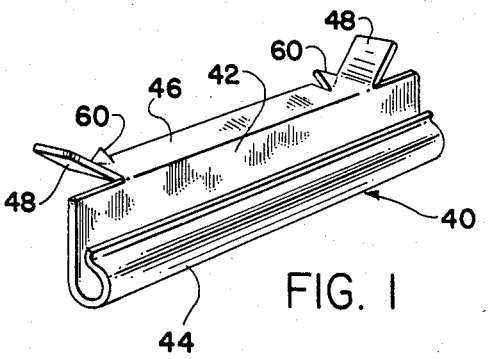
FIG. 1 is a perspective view of the present invention defining a security device in the form of a self-attaching clip.
Figure 3:
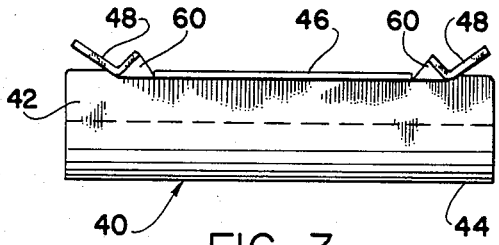
FIG. 3 is an enlarged rear view of the security clip.
Figure 4:
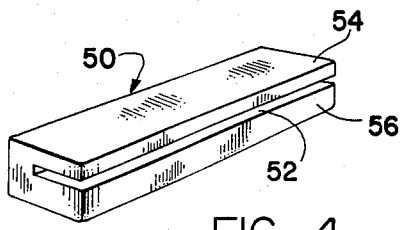
FIG. 4 is a perspective view of the spacer bar.
Figure 2:
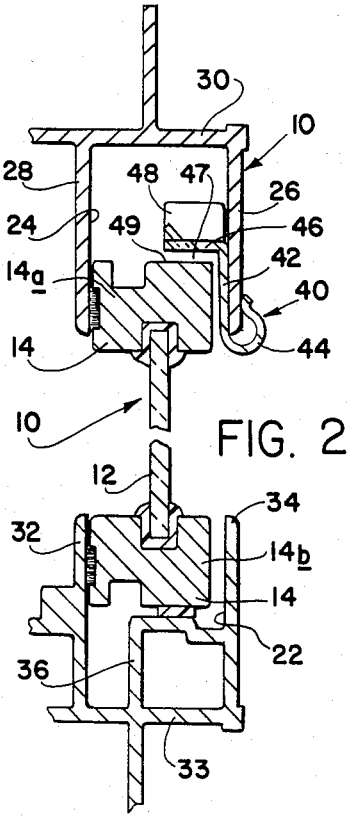
FIG. 2 is a cross-sectional view showing the security device mounted in the preferred manner to the upper channel of the window frame.

Referring more particularly to FIG. 2, there is shown a sectional view of a typical sliding window, generally indicated at 10, which includes window glass 12 having well-known slidable sash members 14 defining the window frame. The term sliding-window frame 10 will hereinafter relate to the window glass and its peripheral sash members.

Further, it should be understood that the present invention is readily suitable for use with a sliding door which has components similar to those of a sliding window.

As is well known, the sliding window 10 is slidably mounted within its associated frame structure, which is fixed within a supporting wall structure (not shown).

Commonly, the frame structure and sash members 14 are constructed of heavy-gauge aluminum extrusions, as seen in FIG. 2, wherein the frame structure comprises a lower track member 22 and an upper recessed channel 24. The recessed channel 24 is defined by depending side walls or flanges 26 and 28, and top wall 30. The lower track member 22 is formed by oppositely disposed vertical walls 32 and 34 connected by bottom wall 33. Included therein is a typical rail member 36 on which sliding-window frame 10 is movably supported.

Typically, window frame 10 is inserted into frame 16 by positioning the upper sash member **14*a* of window frame 10 into channel 24, the depth of the channel being such that the lower edge of sash 14*b* clears wall 34 of lower track 22. Therefore, it is a simple procedure to remove window frame 10 from the frame structure, so that unauthorized removal of the window frame 10** from the outside as well as from the inside can be readily accomplished. Hence, the present invention has been designed to prevent such removal of a window frame from its frame structure to gain unauthorized entry.

The invention defines a security device, generally indicated at 40, which comprises a spring-tension clip having a flat wall mainstay 42, the lower or bottom portion thereof being formed with a spring-tension means arranged as an upwardly turned jaw-like member 44. This jaw member is formed in a substantially S-shaped configuration, wherein the depending flange 26 is forceably received between the wall mainstay 42 and jaw 44, thus establishing a spring tension therebetween so as to grasp the depending flange 26, as seen in FIG. 2, whereby the security clip is held in place.

Once in place, the mainstay 42 projects upwardly into channel 24 adjacent the inner side of flange 26, thereby allowing free and uninterrupted sliding movement of the window frame 10 but also preventing the window frame 10 from being lifted upwardly.

Security clip 40 is further provided with stop or abutting means which is defined by a laterally bent flange or lip member 46. This lip member extends outwardly into channel 24 so as to project over the upper sash member **14*a*, as seen in FIG. 2, thereby forming a stop or abutment means against which sash 14*a* would engage when the window frame is raised upwardly out of track 22. Hence, it can be readily understood that the lower sash 14*b* can not be raised high enough to clear wall 34 of track member 22**.

In order to provide additional strength to the clip, there is formed on each opposite end of the longitudinal abutment lip an upturned ear member 48, the ears being angularly disposed so as to firmly engage the inner surface of depending wall 26 when the window frame 10 is forced upwardly to engage lip 46. The engagement of ears 48 prevents any bending of lip 46.

Figure 5:
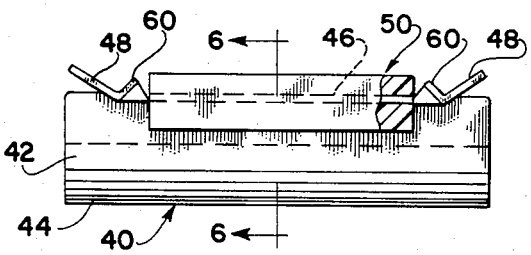
FIG. 5 is a rear view of the security clip having the spacer bar mounted thereon.
Figure 6:
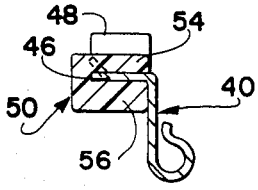
FIG. 6 is a cross-sectional view taken substantially along line 6—6 of FIG. 5.

Thus, as illustrated in FIG. 2, abutment lip 46 is in close proximity to the upper edge 49 establishing space 47. Therefore, window frame 10 can be raised only very slightly. However, in cases where the distance between lip 46 and edge 49 is much greater, there is provided a space-control means, designated at 50. The space-control means is defined by a spacer bar having a generally elongated, rectangular configuration with a longitudinal slot 52 formed therein. The slot is located adjacent the central portion so as to define a pair of spacer-abutment members 54 and 56. Thus, the position of slot 52 further defines spacer member 54 as having less thickness than member 56. Accordingly, when space 47 between lip 46 of clip 40 is larger than that shown in FIG. 2, spacer bar 50 is fitted over lip 46 as seen in FIGS. 5 and 6. Thus, depending upon the size of space 47, clip 40 can either be used by itself as seen in FIG. 2, or with spacer bar 50 as seen in FIGS. 5 and 6, where the thickest member 56 is in position to be engaged by sash **14*a* when it is lifted upwardly. Still another arrangement is possible by reversing spacer bar 50, whereby spacer member 54 is positioned below the lip 46**.

Means to prevent longitudinal movement of spacer bar 50 is provided in the form of crimp members 60. Each crimp member is located adjacent ears 48 so as to receive spacer bar therebetween. This arrangement prevents not only longitudinal movement of bar 50, but prevents bar 50 from engaging either of the ear members 48.

In order to insert or remove the present security clip 40, the sliding window must be opened sufficiently to clear clip 40. That is, the window 10 is moved laterally within track member 22 and channel 24, thus clearing the security device.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A security device to prevent removal of sliding windows and doors which are slidably mounted within a channeled frame structure, wherein the device comprises:

a security clip adapted to be removably attached to a depending flange of said channeled frame structure;

said security clip formed having a mainstay-wall member which projects upwardly into a channel of the frame structure adjacent the inner side of said depending flange;

a spring-tension-engaging means formed longitudinally along the lower portion of said mainstay-wall member, whereby said device is forceably retained within said channel, said spring-tension-engaging means comprising a jaw member formed in a substantially S-shaped configuration, whereby said depending flange of said frame structure is forceably received between said mainstay member and said jaw member;

an inwardly projecting, abutment-lip member formed longitudinally along the upper portion of said mainstay-wall member so as to be engaged by said window or door, when raised upwardly within said channeled frame structure, to limit the movement thereof; and an angularly disposed ear member formed on opposite ends of said abutment-lip member to engage said depending flange of said channel, when said lip is engaged by said window or door; and a space-control means mounted to said abutment lip to accommodate for the different spaces established between various windows or doors and their associated frame structures, so as to control the upward movement of said windows or doors within said frame structures.

2. A security device as recited in claim 1, wherein said space-control means comprises an elongated spacer bar having a longitudinal slot formed therein, said slot being formed to receive said abutment lip therein.

3. A security device as recited in claim 2, wherein said slot formed in said spacer bar is disposed to define a pair of abutment members, one abutment member being thicker than the other abuttment member.

4. A security device as recited in claim 3, wherein said abutment lip of said clip includes means to prevent lateral movement of said spacer bar along said lip.

5. A security device as recited in claim 4, wherein said means to prevent lateral movement of said spacer bar comprises a pair of crimp members formed in said outwardly projecting, abutment lip, said crimp members being spaced apart whereby said spacer bar is mounted and secured therebetween.

6. A security device as recited in claim 1, wherein said inwardly projecting, abutment-lip member includes means to prevent lateral movement of said spacer bar.

7. A security device as recited in claim 6, wherein said means to prevent lateral movement of said spacer bar comprises a pair of crimp members formed in said abutment lip, said crimp members being spaced apart whereby said spacer bar is mounted and secured therebetween.

8. A security device as recited in claim 7, wherein said spacer bar is formed having a first abutment member and a second abutment member, each of said abutment members being defined by a longitudinal slot formed in said spacer bar, said first abutment member having a different thickness than said second abutment member.

* * * * *